US008641112B1

(12) United States Patent
Anderson

(10) Patent No.: US 8,641,112 B1
(45) Date of Patent: Feb. 4, 2014

(54) HANDHELD METALLIC DEBRIS COLLECTOR

(76) Inventor: Luke Anderson, Tampa, FL (US)

( * ) Notice: Subject to any disclaimer, the term of this patent is extended or adjusted under 35 U.S.C. 154(b) by 0 days.

(21) Appl. No.: 13/397,220

(22) Filed: Feb. 15, 2012

(51) Int. Cl.
*B66C 1/04* (2006.01)
*E21B 31/06* (2006.01)

(52) U.S. Cl.
USPC ..... 294/65.5

(58) Field of Classification Search
USPC ..... 294/65.5, 190, 209; 335/285, 289, 335/290–294, 302–306; 15/104.001, 105, 15/257.01, 257.1, 1.51, 1.52; 209/213, 209/223.1, 228; 81/24
See application file for complete search history.

(56) References Cited

U.S. PATENT DOCUMENTS 1,347,382 A * 7/1920 Karro ..... 294/65.5
2,976,075 A * 3/1961 Budreck ..... 294/65.5
4,059,155 A * 11/1977 Greer ..... 166/301
4,407,038 A 10/1983 Haase
4,802,702 A * 2/1989 Bownds ..... 294/65.5
6,325,433 B1 * 12/2001 Nicholson et al. ..... 294/65.5
7,131,678 B2 * 11/2006 Ernesti ..... 294/65.5
2008/0078698 A1 4/2008 Lin et al.

* cited by examiner

*Primary Examiner* — Stephen Vu
(74) *Attorney, Agent, or Firm* — Ronald E. Smith; Smith & Hopen, P.A.

(57) ABSTRACT

A handheld device for collecting, retaining, and discarding small metallic debris located on a desk surface. The body of the device includes two main components: A reservoir for collecting metallic debris and a hollow magnet housing that contains a permanent magnet and a raising mechanism. The magnet is placed inside the magnet housing and is capable of being raised and lowered. When the magnet is in its low position, its magnetic field extends beyond the reservoir thus attracting metallic debris to the top surface of the reservoir. To discard the collected metallic debris, the magnet is raised via the raising mechanism to a position in which the metallic debris is no longer within the magnetic field. Several mechanical raising mechanisms are disclosed.

3 Claims, 3 Drawing Sheets

HANDHELD METALLIC DEBRIS COLLECTOR

BACKGROUND OF THE INVENTION

1. Field of the Invention

This invention relates to a handheld device using magnetic force for collecting and discarding loose metallic debris.

2. Description of the Related Art

In a common office, school, or home environment, small magnetic metal objects, such as staples, paper clips, nails, pins, etc., often become scattered on a desk surface. These loose metal objects tend to go unnoticed due to their small size and may accumulate, thus resulting in an untidy workspace. Furthermore, objects such as staples, nails, pins, and screws may pose a hazard because of their sharp points and edges. When sharp metal objects come into contact with skin, they may cause painful cuts, and once skin is pierced, there is a danger that the wound may become infected, thus leading to further complications and creating a possibility of more serious health problems. Therefore, small metal debris creates two problems: (1) disorganized workspace, and (2) risk of a potential injury.

Cleaning up metal debris may be a problematic task because small metal objects may be difficult to detect visually. Moreover, manually picking up sharp metal objects is undesirable due to a possibility of receiving a cut. For these reasons, a need exists for a device capable of efficiently and safely collecting, retaining, and discarding metallic debris.

This problem has been recognized by others, and several prior art references disclose devices intended to solve similar problems. For example, published U.S. patent application No. 2008/0078698 teaches a mop-like device using magnetic force for collecting and discarding metal objects. U.S. Pat. No. 4,407,038 discloses a magnetic sweeper that permits relatively easy operation for picking up metallic debris, but presents inconveniences for removing the captured debris. Furthermore, most prior art teaches sweeper-like devices that are fairly large and clumsy. Although such devices may work well for sweeping, they are very inconvenient for cleaning up small metallic debris located on a desktop.

Accordingly, there is a need for a small ergonomic device that enables safe and efficient collection and retention of metallic debris from a support surface.

There is also a need for such a device that discards the collected debris in a safe and efficient manner.

SUMMARY OF THE INVENTION

The primary objective of the present invention is collecting and discarding small metallic debris. The body of the invention is composed of two parts: a reservoir for containing debris and a hollow magnet housing that contains a magnet and a raising mechanism. The novel structure utilizes a magnet for picking up and retaining metallic debris. The magnet is placed inside the body of the invention and may be raised or lowered. When the magnet is in its initial low position, it rests on a top surface of the reservoir. In this position, the magnetic field extends beyond the reservoir, thus attracting metallic debris to the top surface of the reservoir. As long as the metallic debris remains within the magnetic field where the magnetic forces are capable of overcoming the weight of the metallic debris, the debris will be retained inside the reservoir.

When a user wishes to discard the metallic debris, the user raises the magnet via a raising mechanism. As the distance between the metallic debris held inside the reservoir and the magnet increases, the magnitude of magnetic forces acting on the metallic debris decreases. When the magnet reaches an elevated position, the magnetic forces become incapable of overcoming the weight of metallic debris, and the collected debris falls out from the bottom opening of the reservoir.

The invention has several contemplated embodiments. The raising mechanisms vary between each embodiment. All raising mechanisms serve the function of raising the magnet to a position where collected debris is outside of the magnetic field, but differ in structure and complexity. Shapes of magnet housings also vary between embodiments to accommodate different raising mechanisms and also to serve ergonomic functions.

Although numerous embodiments are possible, there are three main ones. The first embodiment is the simplest one: a handle is attached to the magnet, and the magnet housing has elongated openings on both sides, through which the ends of the handle protrude. To raise the magnet, a user applies a vertical force simultaneously to both ends of the handle, while holding the magnet housing in place.

The second embodiment utilizes a lever to raise the magnet. A vertical member is attached to the magnet and a guiding tube is fixedly positioned inside the magnet housing and receives the vertical member. The guiding tube restricts the vertical component to exclusively vertical movement. The first end of the lever is pivotally attached to the vertical member, while the second end protrudes through an opening on the side of the magnet housing. The lever is pivotally attached to the magnet housing. When a user applies a downward force to the protruding end of the lever, the end of the lever connected to the vertical member exerts an upward force on the vertical member, thus raising the magnet attached thereto.

The third embodiment involves a guide rail and a linear bearing adapted to slide along the guide rail. The guide rail is positioned at an angle inside the magnet housing. An elevating member is attached to the magnet and the linear bearing. The magnet housing in this embodiment has a shape resembling a computer mouse with an elongated opening over the guide rail. The free end of the elevating member protrudes through the opening. To raise the magnet, a user holds the magnet housing in a palm of a hand and uses a finger to slide the elevating component along the guide rail. In all three embodiments, the weight of the magnet returns it to its initial low position.

It should be noted that the foregoing schematic description and the following detailed description of the present invention only exemplify the present invention and do not limit the scope of the present invention.

BRIEF DESCRIPTION OF THE DRAWINGS

For a fuller understanding of the invention, reference should be made to the following detailed description, taken in connection with the accompanying drawings, in which:

FIG. 1(*b*) is a front view of the first embodiment of the invention in its discarding configuration;

FIG. 2(*b*) is a cross-sectional view of the second embodiment of the invention in its discarding configuration;

FIG. 3(*b*) is a cross-sectional view of the third embodiment of the invention in its discarding configuration.

DETAILED DESCRIPTION OF THE INVENTION

Figure 1A:
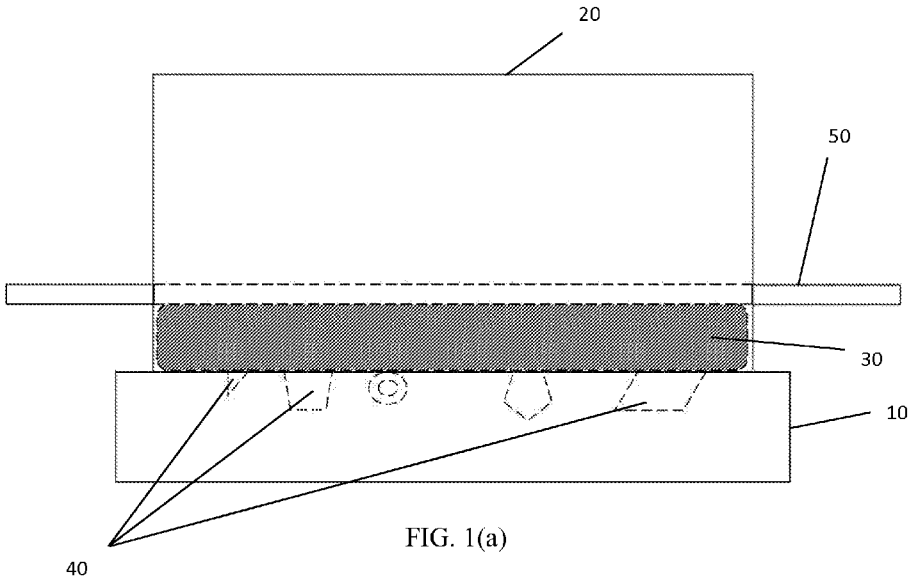
FIG. 1(*a*) is a front view of the first embodiment of the invention in its collecting configuration.
Figure 1B:
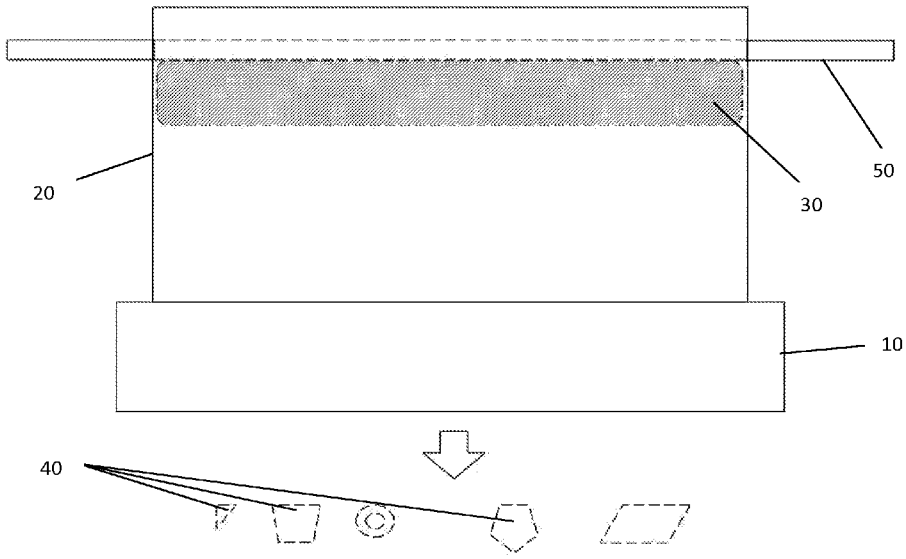
Figure 2A:
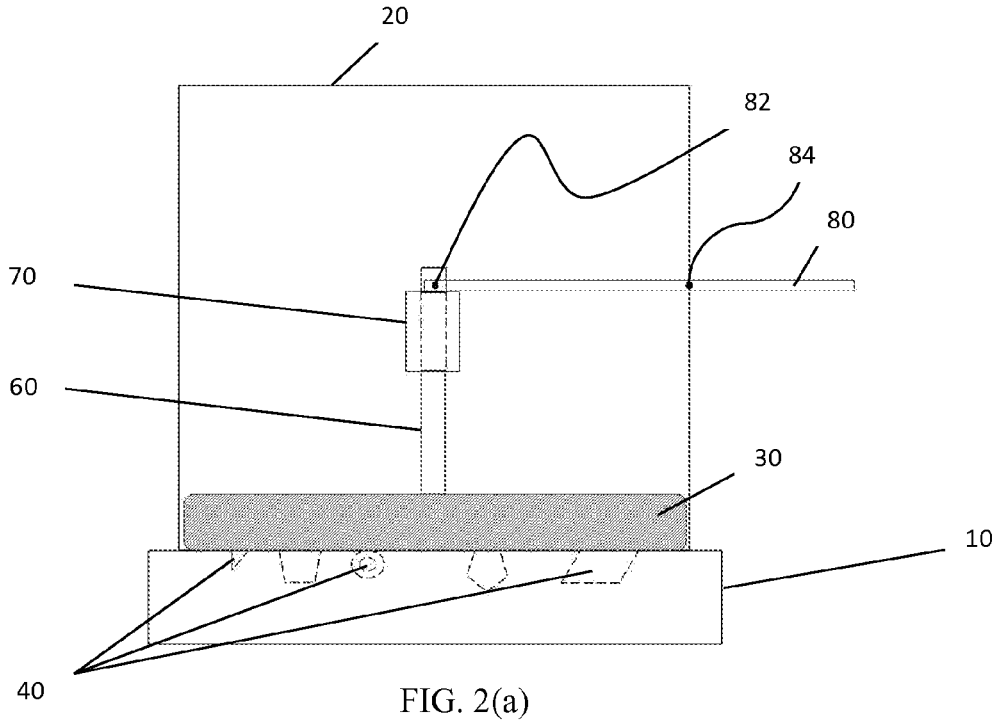
FIG. 2(*a*) is a cross-sectional view of the second embodiment of the invention in its collecting configuration.
Figure 2B:
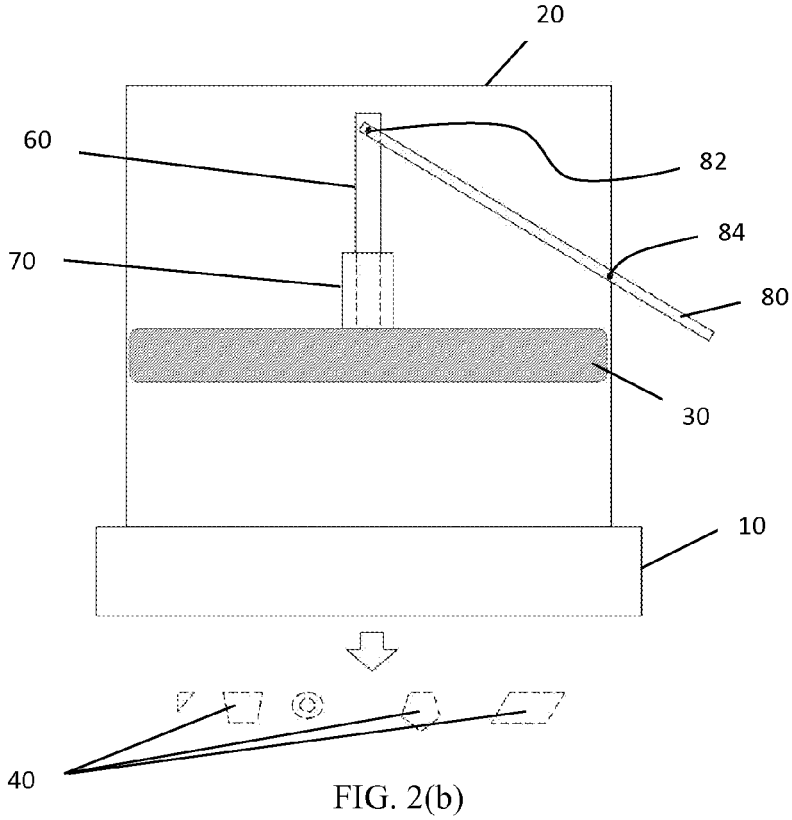
Figure 3A:
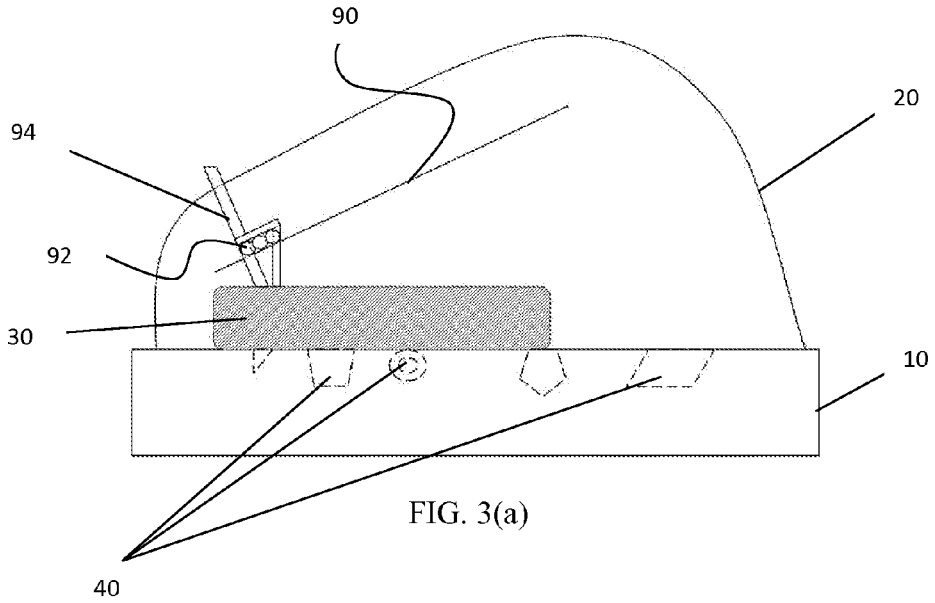
FIG. 3(*a*) is a cross-sectional view of the third embodiment of the invention in its collecting configuration.
Figure 3B:
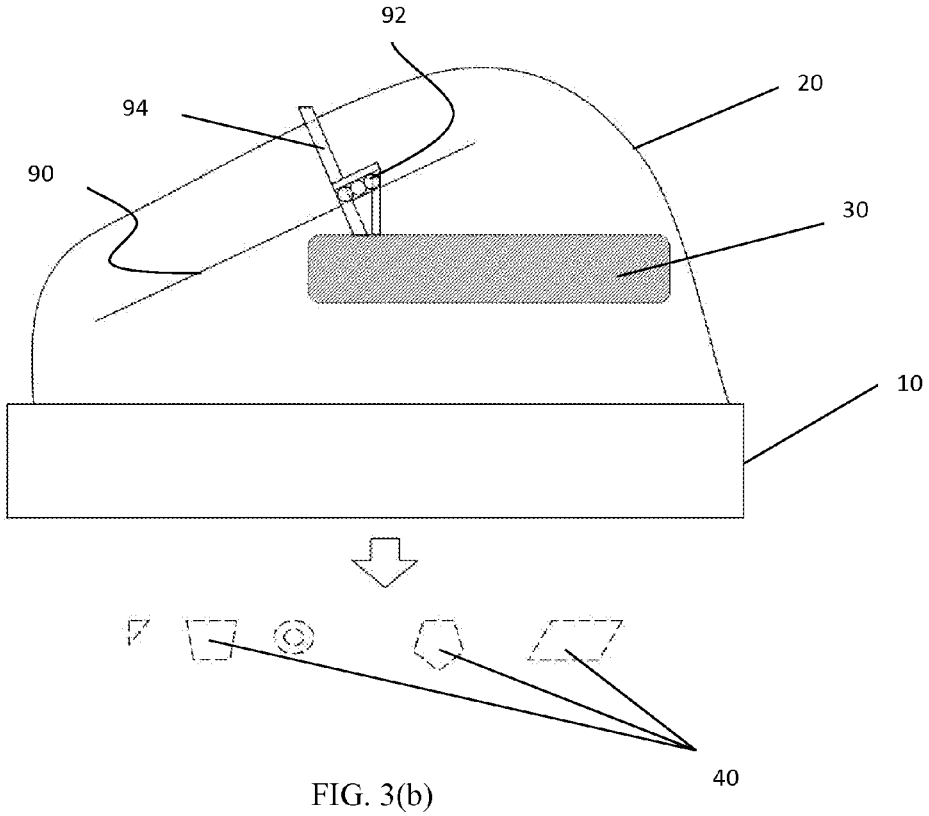

Three distinct embodiments of the claimed invention are depicted in FIGS. 1-3. The scope of the invention is not limited to those embodiments as several others are also contemplated. Referring to FIGS. 1-3, the invention includes reservoir 10 for containing metallic debris 40. Reservoir 10 has a top surface, a side edge, and a bottom opening. Reservoir 10 may have any geometric shape so long as the height of the side edge is uniform throughout, so that reservoir 10 is always in a stable position when placed on a flat surface. Hollow magnet housing 20 is attached to the top surface of reservoir 10. Permanent magnet 30 is placed inside said magnet housing. Permanent magnet 30 must be such that its static magnetic field extends beyond the height of the side edges of reservoir 10 when magnet 30 is resting at the bottom of magnet housing 20, as depicted in FIG. 1(*a*).

According to the embodiment of the invention depicted in FIGS. 1(*a*) and 1(*b*), handle 50 is attached to magnet 30. Opposite ends of handle 50 protrude through elongated openings on both sides of magnet housing 20. To operate this embodiment of the invention, a user places the bottom opening of reservoir 10 over metallic debris 40. Magnetic forces produced by magnet 30 overcome the weight of metallic debris 40, thus attracting it to the top surface of reservoir 10. For as long as magnet 30 is in its initial low position, metallic debris will be contained inside reservoir 10. When a user wishes to discard collected metallic debris 40, the user picks up the device and holds it over a target area, such as an opening of a trash bin. When the device is in a desired position, the user exerts an upward force on the protruding opposite ends of handle 50 to raise magnet 30 to its elevated position (FIG. 1(*b*)). In this position, the magnetic field produced by magnet 30 is distanced sufficiently far from the top surface of reservoir 10 so that magnetic forces at the top surface of reservoir 10 become incapable of overcoming the weight of metallic debris 40. Accordingly, metallic debris 40 falls out from the bottom opening of reservoir 10. Magnet 30 is then lowered to its starting position and the device is ready for collecting more metallic debris.

A second embodiment is depicted in FIGS. 2(*a*) and 2(*b*). This embodiment differs from the first embodiment in its mechanism of raising the magnet from its low position to its elevated position. The raising mechanism in this embodiment is composed of vertical member 60, guiding tube 70, and lever 80. Vertical member 60 is attached to magnet 30. Guiding tube 70 is fixedly positioned within magnet housing 20. Guiding tube 70 receives vertical member 60 and constricts its movement: vertical member 60 is only capable of a motion along a vertical axis of guiding tube 70. Lever 80 is positioned partially inside magnet housing 20, with a first end pivotally connected to vertical member 60 at pivot point 82, and a second end protruding outside of magnet housing 20. Lever 80 is pivotally connected to magnet housing 20 at pivot point 84.

When a user wishes to discard collected metallic debris 40, the user applies a downward force to the protruding end of lever 80, thus causing the lever to exert an upward force on vertical member 60, thus raising vertical member 60 and magnet 30 attached thereto. Once metallic debris 40 is outside of the magnetic field produced by magnet 30, metallic debris 40 will fall out from the bottom opening of reservoir 10. When the user discontinues applying vertical force to the free end of lever 80, the weight of magnet 30 returns magnet 30 to its initial low position, i.e., its position of repose, and the device is ready for collecting more metallic debris.

A third embodiment of the invention is depicted in FIGS. 3(*a*) and 3(*b*). In this embodiment, the raising mechanism includes three main components: guide rail 90, linear bearing 92, and elevating member 94. Guide rail 90 is positioned at a predetermined angle within magnet housing 20. Magnet housing 20 has a shape similar to that of a computer mouse and is adapted to fit in a palm of a user's hand. Magnet housing 20 has an elongated opening along guide rail 90. A first end of elevating member 94 is attached to permanent magnet 30, and a second end protrudes through the elongated opening in magnet housing 20. Linear bearing 92 is attached to elevating member 94. Linear bearing 92 is adapted to slide along guide rail 90 and is used to reduce friction and ensure smooth movement of elevating member 94 along guide rail 90.

Collecting metallic debris 40 is accomplished by placing the bottom opening of reservoir 10 over metallic debris 40 when magnet 30 is in its initial low position. The magnetic forces produced by magnet 30 attract metallic debris 40 to top surface of reservoir 10 and retain metallic debris 40 inside reservoir 10. To discard collected metallic debris 40, a user holds magnet housing 20 with a palm of a hand and places a finger on the protruding end of elevating member 94. The user then exerts a force on elevating member 94 to slide the elevating member 94 up along guide rail 90. This raises permanent magnet 30 to its elevated position, in which metallic debris 40 is outside the magnetic field of magnet 30. Accordingly, the weight of metallic debris 40 causes metallic debris 40 to fall out from the bottom opening of reservoir 10. Once the user discontinues applying a force to elevating member 94, the weight of magnet 30 causes elevating member 94 to slide down along guide rail 90, thus returning magnet 30 to its initial low position, i.e., its position of repose.

Although the main three embodiments of the invention are described in detail, the foregoing disclosure is not intended to limit the scope of the invention to those embodiments. Other contemplated embodiments may utilize cable and pulley systems to raise magnet 30, for example. The invention may also involve a small electric motor as a part of its raising mechanism.

What is claimed is:

1. A handheld metallic debris collector, comprising:

a reservoir adapted to contain metallic debris, the reservoir having a top surface and a bottom opening adapted to rest on a desk surface;

a magnet housing surmounting the reservoir;

a permanent magnet positioned inside the magnet housing, wherein the magnet produces a static magnetic field capable of overcoming the weight of the metallic debris;

the magnet housing being adapted to fit in a palm of a user's hand;

a guide rail positioned at an angle within the magnet housing;

a linear bearing slidingly connected to the guide rail;

an elevating member having a first end, a second end, and a middle portion;

a means of raising the magnet from a low position in which the reservoir is inside the static magnetic field to an elevated position in which the reservoir is outside the static magnetic field, so that when the magnet is in the low position, the metallic debris is attracted to and retained within the reservoir, and when the magnet is in the elevated position, the metallic debris is discarded through the bottom opening of the reservoir;

said means of raising the magnet including the first end of said elevating member being attached to the magnet, the middle portion of said elevating member being attached to the linear bearing, and the second end of said elevating member protruding from the magnet housing, wherein applying a force to the second end causes the linear bearing to slide along the guide rail thus raising the magnet.

2. A handheld metallic debris collector, comprising:

a reservoir having a top wall and side walls mounted about the periphery of the top wall and depending therefrom, said reservoir having an open bottom adapted to rest on a support surface;

a magnet housing surmounting the top wall of the reservoir;

a permanent magnet positioned inside the magnet housing, said permanent magnet producing a static magnetic field having a strength sufficient to lift metallic debris that is positioned on the support surface;

the magnet housing being adapted to fit in a palm of a user's hand so that a user may position the reservoir in registration with the magnetic debris positioned on the support surface;

said magnet having a first, low position in which the static magnetic field extends at least to the open bottom of said reservoir and therefore to said magnetic debris positioned on the support surface when said reservoir is positioned in said registration;

said magnet having a second, raised position, said second position having a higher elevation than said first position relative to said top wall of the reservoir in which the static magnetic field does not extend below the top wall of the reservoir;

said metallic debris being attracted to the top wall of the reservoir and being retained within the reservoir when said magnet is in said first, low position;

said metallic debris falling under the force of gravity from said top wall of said reservoir when said magnet is in said second, raised position.

3. The handheld magnetic debris collector of claim 2, further comprising:

a guide rail positioned at an angle within the magnet housing, a first end of said guide rail being positioned in a lower elevation than a second end of said guide rail;

a linear bearing slidingly connected to the guide rail;

an elevating member having a first end attached to the magnet;

said elevating member having a second end that protrudes through an elongate opening formed in said magnet housing;

said elevating member attached to the linear bearing at a point between said first and second ends;

said magnet being in said first, low position when said magnet is positioned at the first end of said guide rail;

said magnet being in said second, raised position when said magnet is positioned at the second end of said guide rail;

whereby a user raises said magnet from said first, low position to said second, raised position by displacement of said elevating member.

* * * * *